US010492574B2

(12) United States Patent
de Iuliis et al.

(10) Patent No.: US 10,492,574 B2
(45) Date of Patent: Dec. 3, 2019

(54) CLASP MECHANISMS FOR WRIST-WORN DEVICES

(71) Applicant: Apple Inc., Cupertino, CA (US)

(72) Inventors: Daniele de Iuliis, Cupertino, CA (US); Michael J. Webb, Scotts Valley, CA (US)

(73) Assignee: APPLE INC., Cupertino, CA (US)

( * ) Notice: Subject to any disclaimer, the term of this patent is extended or adjusted under 35 U.S.C. 154(b) by 354 days.

(21) Appl. No.: 15/256,842

(22) Filed: Sep. 6, 2016

(65) Prior Publication Data

US 2017/0086536 A1 Mar. 30, 2017

Related U.S. Application Data

(60) Provisional application No. 62/233,463, filed on Sep. 28, 2015.

(51) Int. Cl.

| | |
|---|---|
| ***A44C 5/10*** | (2006.01) |
| ***A44C 5/20*** | (2006.01) |
| ***G04B 37/14*** | (2006.01) |

(52) U.S. Cl.

CPC ..... *A44C 5/107* (2013.01); *A44C 5/2076* (2013.01); *G04B 37/1493* (2013.01)

(58) Field of Classification Search

CPC ..... A44C 5/107; A44C 5/2076
USPC ..... 224/164
See application file for complete search history.

(56) References Cited

U.S. PATENT DOCUMENTS

| | | | | |
|---|---|---|---|---|
| 1,701,970 | A * | 2/1929 | Chaunard | A44C 5/2076 24/665 |
| 1,797,583 | A | 3/1931 | Miller | |
| 2,388,554 | A | 11/1945 | Kreisler et al. | |
| 2,429,036 | A * | 10/1947 | Taegtstroem | A44C 5/107 59/79.3 |
| 2,451,780 | A | 10/1948 | Siska | |
| 2,564,652 | A | 8/1951 | Templeman | |
| 2,613,415 | A | 10/1952 | Ritter | |
| 2,648,884 | A | 8/1953 | Loofboro | |
| 2,696,689 | A | 12/1954 | Speck et al. | |
| 2,840,982 | A * | 7/1958 | Stiegele | A44C 5/08 59/79.1 |
| 3,208,211 | A * | 9/1965 | Heinz | A44C 5/08 59/79.1 |

(Continued)

FOREIGN PATENT DOCUMENTS

| | | |
|---|---|---|
| CN | 201393583 | 2/2010 |
| DE | 2854004 | 7/1980 |

(Continued)

*Primary Examiner* — Derek J Battisti
(74) *Attorney, Agent, or Firm* — Morgan, Lewis & Bockius LLP

(57) ABSTRACT

A band configured to couple a device to a body of a user is disclosed. The band includes a first link comprising a recess defined in a body of the first link, a leaf spring positioned in the recess and comprising a tongue portion protruding from the leaf spring, and a second link coupled to the first link and comprising first and second lip portions extending away from a body of the second link and separated from one another by a gap. The tongue portion is positioned in the gap between the first and second lip portions, and the first and second lip portions engage the leaf spring to retain the second link to the first link.

12 Claims, 18 Drawing Sheets

(56) References Cited

U.S. PATENT DOCUMENTS

| | | | | |
|---|---|---|---|---|
| 3,416,305 | A * | 12/1968 | Rieth | A44C 5/04 224/175 |
| 4,051,668 | A * | 10/1977 | Learn | A44C 5/107 59/80 |
| 4,458,478 | A * | 7/1984 | North | A44C 5/107 224/175 |
| 4,763,490 | A * | 8/1988 | Bruner | A44C 5/2076 24/615 |
| 4,930,304 | A * | 6/1990 | Meister | A44C 5/027 59/80 |
| 4,941,236 | A | 7/1990 | Sherman et al. | |
| 5,689,868 | A * | 11/1997 | Hartmann | A44C 5/2076 24/191 |
| 6,237,319 | B1 | 5/2001 | Amundsen et al. | |
| 6,406,177 | B1 * | 6/2002 | Fukushima | A44C 5/10 224/168 |
| 7,021,041 | B2 | 4/2006 | Verdon et al. | |
| 8,191,209 | B2 | 6/2012 | Wolfgang | |
| 8,567,172 | B2 * | 10/2013 | Asami | A44C 5/0053 59/80 |
| 8,576,036 | B2 | 11/2013 | Fullerton et al. | |
| 2005/0252240 | A1 * | 11/2005 | Junod | A44C 5/107 63/10 |
| 2009/0031757 | A1 | 2/2009 | Harding | |
| 2014/0101899 | A1 * | 4/2014 | Moille | A44C 5/185 24/265 WS |
| 2015/0121668 | A1 | 5/2015 | Kaltenrieder | |
| 2016/0037841 | A1 | 2/2016 | Dey et al. | |
| 2016/0037874 | A1 | 2/2016 | Webb et al. | |
| 2016/0236263 | A1 | 8/2016 | Sawyer | |
| 2016/0255922 | A1 | 9/2016 | Hatanaka et al. | |
| 2017/0086536 | A1 | 3/2017 | de Iuliis et al. | |

FOREIGN PATENT DOCUMENTS

| | | |
|---|---|---|
| DE | 202012102780 | 11/2012 |
| EP | 0040504 | 11/1981 |
| EP | 1980170 | 10/2008 |
| EP | 2260910 | 12/2010 |
| EP | 2679113 | 1/2014 |
| WO | WO01032045 | 5/2001 |
| WO | WO03056956 | 7/2013 |

* cited by examiner

CLASP MECHANISMS FOR WRIST-WORN DEVICES

CROSS-REFERENCE TO RELATED APPLICATION(S)

This application is a nonprovisional patent application of and claims the benefit of U.S. Provisional Patent Application No. 62/233,463, filed Sep. 28, 2015 and titled "Clasp Mechanisms for Wrist-Worn Devices," the disclosure of which is hereby incorporated herein by reference in its entirety.

FIELD

This disclosure relates generally to electronic devices, and more particularly to releasable links and clasps for bands that are used to secure electronic devices to persons or objects.

BACKGROUND

Conventional wearable devices, such as wristwatches, include bands that couple the device to a user. For example, a conventional wristwatch typically includes a band that attaches the watch to a user's wrist. Some bands are composed of multiple articulating links, such that the band can flex to match the shape and contours of a user's wrist. Such bands are sometimes known as "bracelet bands." In order for such bands to fit properly, they often need to be resized by adding or removing individual links from the band.

SUMMARY

A band configured to couple a device to a body of a user may include a first link comprising a first recess defined by a first wall and a second link coupled to the first link and comprising a second recess defined by a second wall. The first and second walls face opposite directions and are separated from one another by a space. The band also includes a spring member disposed in the space and comprising a first face configured to engage the first wall and a second face configured to partially engage the second wall by partially overlapping the second wall.

The first link may be pivotally coupled to a third link to form a first link assembly. The second link may be pivotally coupled to a fourth link to form a second link assembly. The first link assembly may be coupled to the second link assembly via the coupling between the first link and the second link.

When the first link or the second link is subjected to a decoupling force, a first portion of the second face may contact a portion of the second wall, and a second portion of the second face may not contact the second wall. When the first link or the second link is subjected to the decoupling force, the first face may be forced against the first wall such that the first portion of the first face contacts the first wall to inhibit decoupling of the first link from the second link.

The spring member may be retained to the second link. The first link may include a channel formed therein, the second link may include a slide member extending from a body of the second link, and the slide member may be received in the channel to substantially prevent rotation of the first link relative to the second link.

The first link may also include a button member configured to deflect the spring member into the second recess such that the first face of the spring member disengages from the first wall, thereby allowing the first link to be decoupled from the second link.

A band configured to couple a device to a body of a user may include a first link comprising a recess defined in a body of the first link, a leaf spring positioned in the recess and comprising a tongue portion protruding from the leaf spring, and a second link coupled to the first link and comprising first and second lip portions extending away from a body of the second link and separated from one another by a gap. The tongue portion may be positioned in the gap between the first and second lip portions, and the first and second lip portions may engage the leaf spring to retain the second link to the first link.

The band may comprise a plurality of link assemblies forming two straps of a wrist band, each strap coupled to an electronic device, and a clasp mechanism releasably coupling the two straps together. The first link may be part of a first link assembly of the plurality of link assemblies and the second link may be part of a second link assembly of the plurality of link assemblies. The first and second link may be removable from one another with a tool, and at least the first link and the second link may be formed of a metallic material.

A first portion of the leaf spring may be positioned within the recess, a second portion of the leaf spring may be disposed outside of the recess, and the tongue portion may extend from the second portion of the leaf spring. The tongue portion may be angled toward the body of the first link. The tongue portion may extend substantially perpendicularly to a longitudinal axis of the leaf spring. The tongue portion may be configured such that a force applied to the tongue portion in a direction towards the body of the first link causes the leaf spring to disengage from the first and second lip portions.

The band may also include a third link pivotally coupled to the first link and comprising a channel formed therein, wherein the channel is aligned with the tongue portion of the leaf spring to allow access to the tongue portion by a tool.

A clasp assembly configured to be coupled to a band of a wearable device may include a clasp body, a clasp cover, and a flexible connecting arm pivotally coupled to the clasp body at a first end of the flexible connecting arm and pivotally coupled to the clasp cover at a second end of the flexible connecting arm. The flexible connecting arm may be configured to deform from an undeformed shape during removal of the band from a device housing, and return to the undeformed shape after removal of the band from the device housing.

The flexible connecting arm may extend along a longitudinal axis and may be configured to bend away from the longitudinal axis by at least +/−10 degrees without plastically deforming the flexible connecting arm. The flexible connecting arm may be configured to twist about the longitudinal axis by at least +/−10 degrees without plastically deforming the flexible connecting arm. The flexible connecting arm may include a nickel-titanium metal alloy or a beta-titanium alloy.

The clasp assembly may be coupled to a band that includes an engagement member configured to be disposed within a channel of the device housing and configured to be slid out of the channel from an end of the channel. The flexible connecting arm may be configured to be deformed from the undeformed shape as a result of the engagement member being slid out of the channel.

The clasp assembly may be movable between an open configuration and a closed configuration. In the open configuration, the flexible connecting arm may be in the undeformed state. In the closed configuration, the flexible connecting arm may be deformed, thereby imparting a biasing force between the clasp body and the clasp cover. In the closed configuration, the clasp cover may be retained to the clasp body.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Wearable devices, such as watches, are typically secured to a user or to an object with a band. Some bands are composed of multiple, pivotally connected links that allow the band to flex to conform to a wearer's wrist. Discussed herein are articulable, interlocking watch band links and/or link assemblies that include quick-release mechanisms that allow users to quickly and easily add and remove links to a watch band.

In some cases, all of the links of a watch band may be quick-release style links. In other cases, a watch band may include some quick-release links, and some permanently or semi-permanently coupled links. Because quick-release functionality is not required for the latter type of link, more permanent, simpler, and potentially stronger mechanisms may be used to couple them together. Additionally, such mechanisms may be used to permanently or semi-permanently couple links that cannot be coupled using welding, bonding, or the like. Accordingly, discussed herein are articulable watch band links and/or link assemblies that include permanent or semi-permanent joining mechanisms.

Watch bands are commonly removable from a watch housing to facilitate repair, replacement, or swapping of bands. While watch bands may include clasps that allow the band to open and close to facilitate application and removal of the device, the rigidity of such clasps may make it difficult to attach or detach a watch band and a watch housing without applying undue stress to the clasp or the links of the band. For example, removal of a band from a watch housing may require the band to be twisted in a direction that the band and the clasp are not flexible. Accordingly, described herein are clasp mechanisms that may provide compliance in a direction that facilitates removal and/or application of the band to a watch housing such that the band or clasp itself is not damaged.

Figure 11:
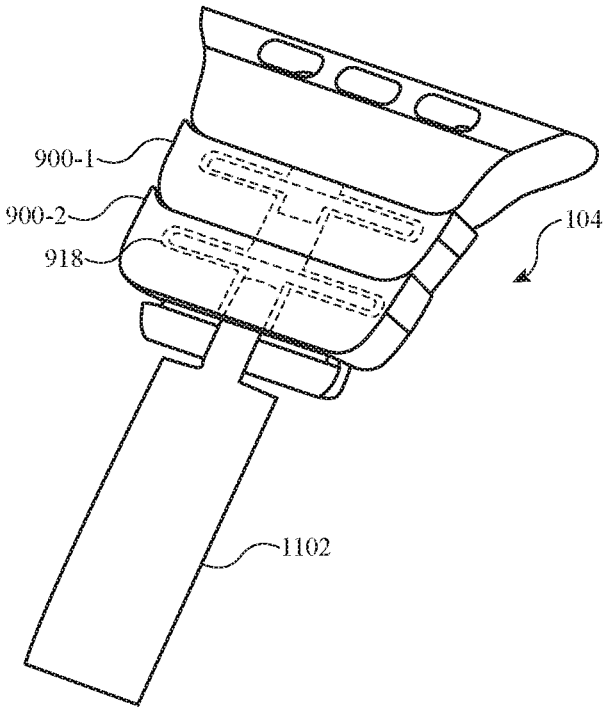
FIG. 11 shows a perspective view of another wearable electronic device.
Figure 12:
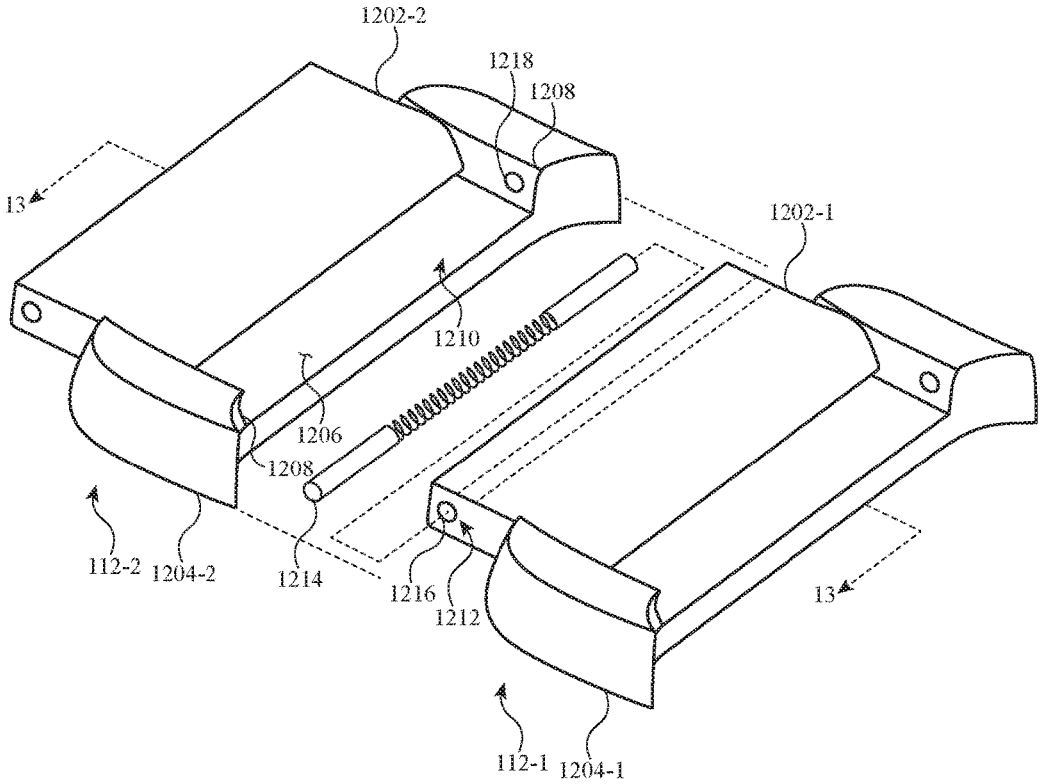
FIG. 12 shows a perspective view of a link assembly.
Figure 13:
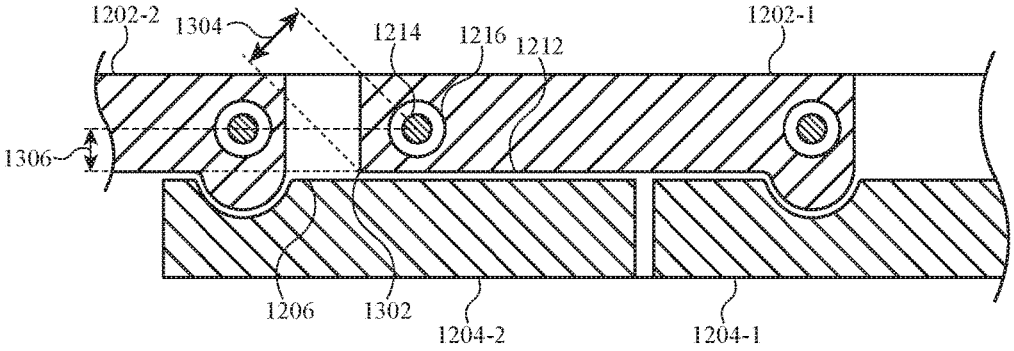
FIG. 13 shows a partial cross-sectional view of the link assembly of FIG. 12 viewed along line 13-13 in FIG. 12.

Various embodiments are described herein with respect to the figures. In particular, FIGS. 1-11 relate to releasable links and link assemblies, including embodiments where the releasable links are configured to slidably engage with one another. FIGS. 12-13 relate to links and link assemblies that are permanently or semi-permanently joined with non-pivoting mechanisms. FIGS. 14-18B relate to compliant clasps. Each of the figures is discussed herein.

Link Assemblies

Figure 1:
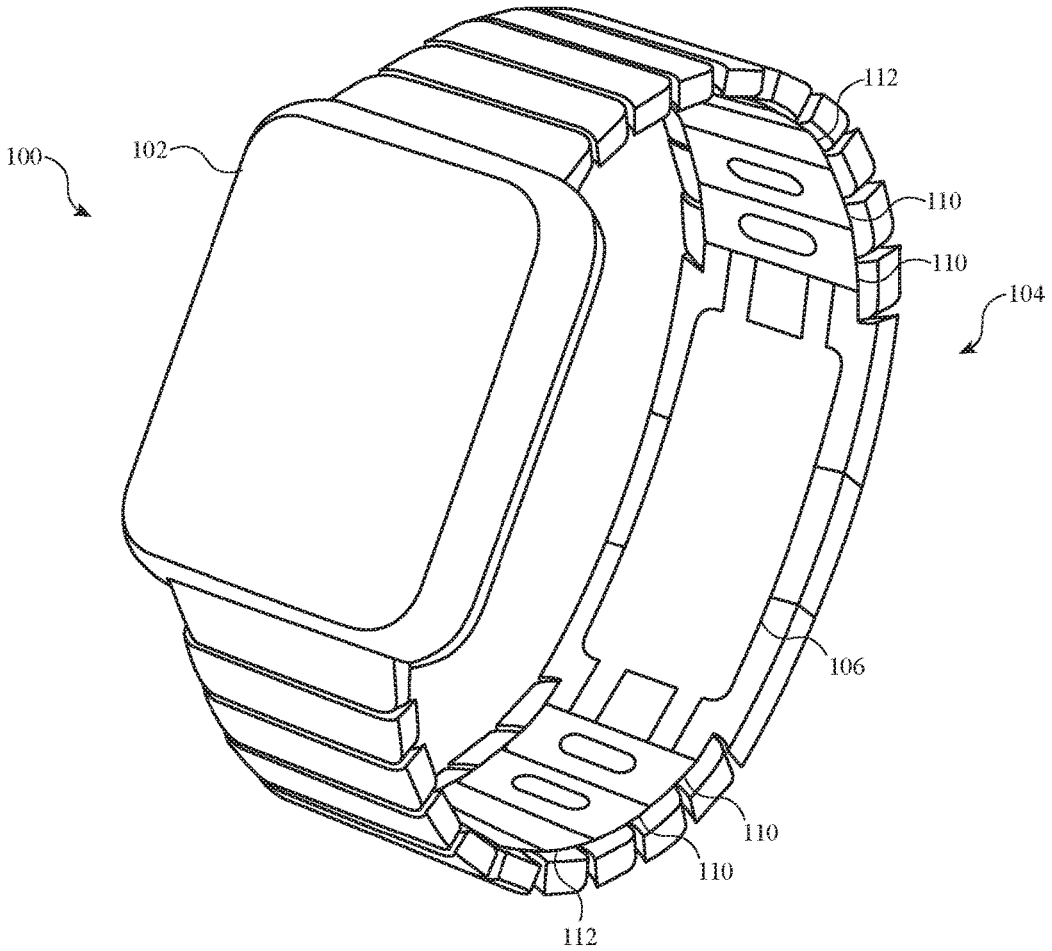
FIG. 1 shows a perspective view of a wearable electronic device.

FIG. 1 is a perspective view of a wearable device 100 (also referred to as "device 100"). The device 100 may be any appropriate wearable device, including an electrical or mechanical wristwatch, an electronic computing device, a health monitoring device, a timekeeping device, a stopwatch, etc.

The device 100 may include a housing 102 that forms an outer surface or partial outer surface and protective case for the internal components of the wearable electronic device 100. The housing 102 may also include mounting features formed on opposite ends to connect a wearable band 104 (also referred to as "band 104") to the housing 102. Examples of such mounting features are shown and described with reference to FIGS. 14A-15.

The band 104 may be composed of or otherwise include multiple links or link assemblies that are coupled to one another to form all or a portion of the band 104, which may be a wrist band for the device 100. The links may include releasable link assemblies 110 and non-releasable link assemblies 112. The releasable link assemblies 110 may be included in the band 104 to allow the user to quickly and easily resize the band 104 to fit their wrist.

The band 104 may also include a clasp 106 that opens and closes to facilitate application and removal of the device 100 to and from a user. The band 104 may be used to secure the device 100 to a user, or to any other object capable of receiving the device 100. In a non-limiting example where the device 100 is a watch, the band 104 may secure the watch to a user's wrist. In other non-limiting examples, the band 104 may secure the device 100 to or within another part of a user's body.

Figure 2A:
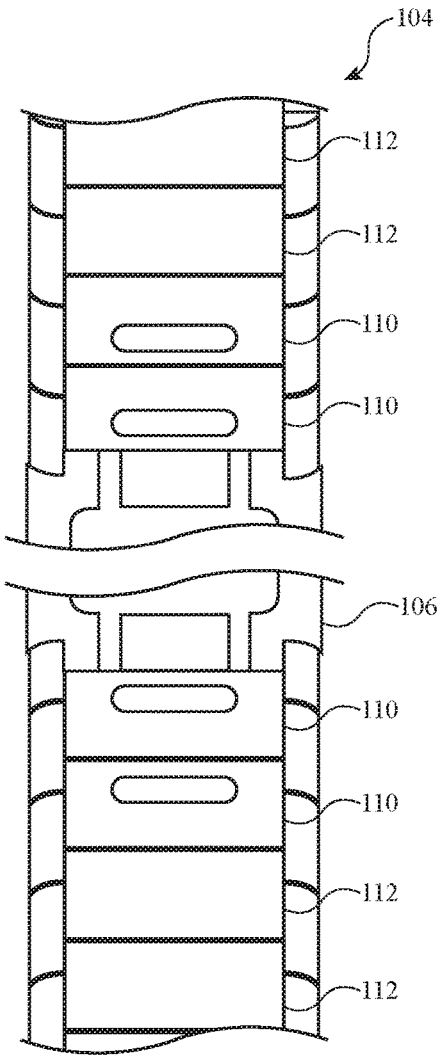
FIGS. 2A-2B show plan views of a band for a wearable electronic device.
Figure 2B:
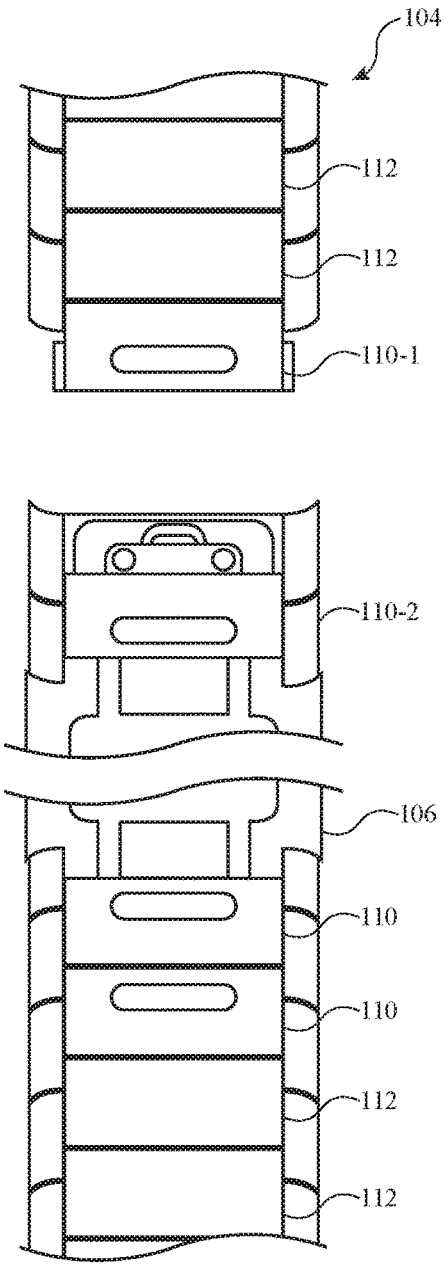

FIGS. 2A and 2B are plan views of an interior portion of the band 104 (e.g., the portion that contacts a wearer's skin), illustrating the band 104 when all of the releasable link assemblies 110 are coupled together (FIG. 2A), and when one releasable link assembly 110-1 is decoupled from another releasable link assembly 110-2 (FIG. 2B).

Figure 3:
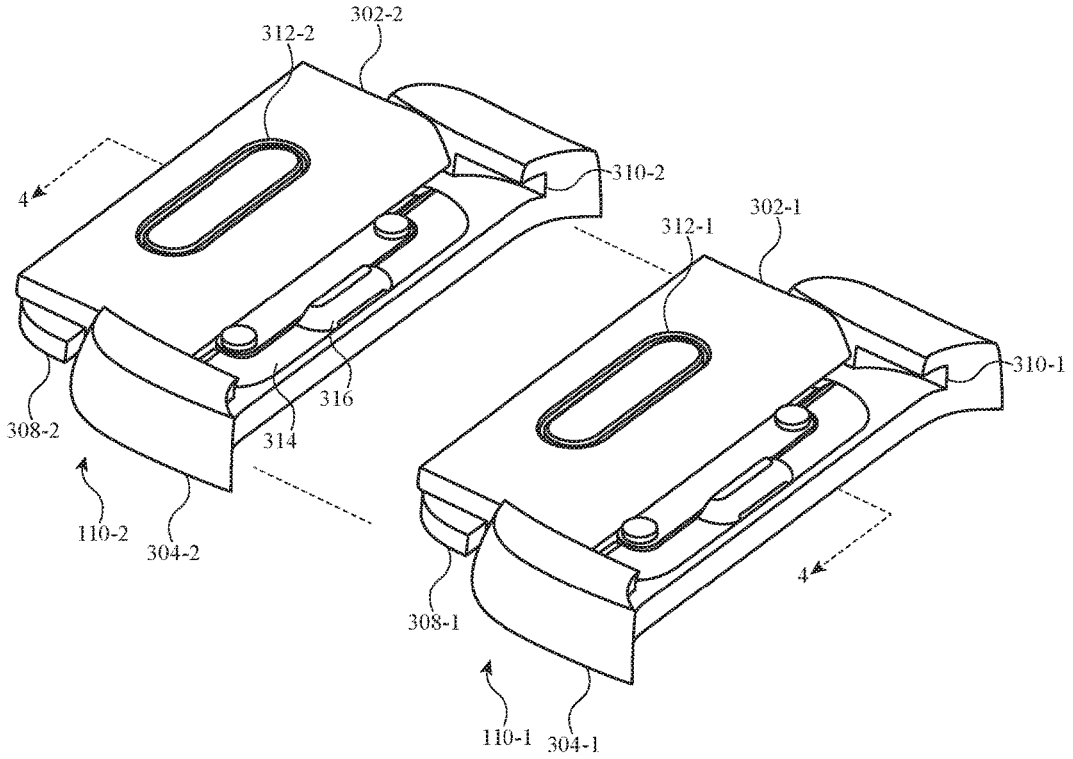
FIG. 3 shows a perspective view of a releasable link assembly.

FIG. 3 is a perspective view of the releasable link assembly 110-1 and a complementary releasable link assembly 110-2. Each releasable link assembly 110 may comprise one or more links coupled together to form the link assembly 110. With reference to FIG. 3, the releasable link assemblies 110 each include a latching link 302 and a receptacle link 304. For example, in the releasable link assembly 110-1, the latching link 302-1 is pivotally coupled to the receptacle link 304-1.

As will be apparent from the figures and description, the latching link of a given releasable link assembly is configured to releasably couple to the receptacle link of another releasable link assembly. Similarly, the receptacle link of the given releasable link assembly is configured to releasably couple to the latching link of yet another releasable link assembly. In this way, a band (or a portion of a band) can be formed by coupling multiple identical releasable link assemblies to one another. Any of the releasable link assemblies can therefore be removed, or new ones added, in order to customize the size of the band.

As shown in FIG. 3, a portion of the latching link 302-1 is configured to at least partially overlap a portion of a body of the receptacle link 304-2 and to be retained to the body of the receptacle link 304-2. For example, the latching link 302-1 includes a first engagement structure 308-1 (e.g., a slide member, a tab, or another feature). The first engagement structure 308-1 is configured to slidably engage with a second engagement structure 310-2 on the receptacle link 304-2. As shown, the first engagement structure 308-1 is a slide member that is configured to be received into the second engagement structure 310-2 (a channel) of the receptacle link 304-2. In some embodiments, the locations of the slide member and the channel are swapped, so that the slide member is disposed on the receptacle link, and the channel is disposed on the latching link. The first and second engagement structures align the latching link with the receptacle link so that the spring member, described below, retains the latching and receptacle links to one another. Further, the slide member and the channel define a sliding axis between the releasable link assemblies, and also provide the physical support that retains the links together in a direction perpendicular to the sliding axis. The engagement between the first engagement structure 308-1 (e.g., a slide) and the second engagement structure 310-2 (e.g., a channel) may also substantially prevent rotation of the latching link 302-1 relative to the receptacle link 304-2. That is, the first and second engagement structures 308-1, 310-2 may form a substantially non-pivoting joint or coupling between the latching link 302-1 and the receptacle link 304-2.

A spring member 314 may be disposed in a space between the latching link 302-1 and the receptacle link 304-2 and may engage with portions of the latching and receptacle links to retain the links together and/or to inhibit unintentional decoupling of the links. For example, when the latching link 302-1 and the receptacle link 304-2 are coupled together, the spring member 314 may extend into a recess in the latching link 302-1 and also into a recess in the receptacle link 304-2 such that the spring member 314 interferes with the free movement of the latching and receptacle links 304-2, 302-1. The spring member 314 therefore inhibits or prevents decoupling or disengaging of the links, until and unless the spring member 314 is disengaged from one of the two recesses.

The spring member 314 may be attached to either a latching link 302 or a receptacle link 304. As shown in FIG. 3, the spring member 314 is attached to the receptacle link 304-2, and is disposed above and/or at least partially in a recess 402 (FIG. 4) in a surface of the receptacle link 304-2. When the latching link 302-1 is attached to the receptacle link 304-2, a protrusion 316 of the spring member 314 engages with the latching link 302-1 to retain the latching link 302-1 to the receptacle link 304-2, as described with respect to FIGS. 4-5B.

The latching link 302-1 includes a button member 312-1 that is configured to disengage the protrusion 316 from the latching link 302-1 when depressed, as described herein. By disengaging the protrusion 316 from the latching link 302-1, the latching link 302-1 can be decoupled from the receptacle link 304-2. The button member 312-1 may be configured to face a user when the band 104 is being worn. In other words, the button member 312-1 may be on a non-cosmetic or non-outwardly facing portion of the latching link 302-1.

Figure 4:
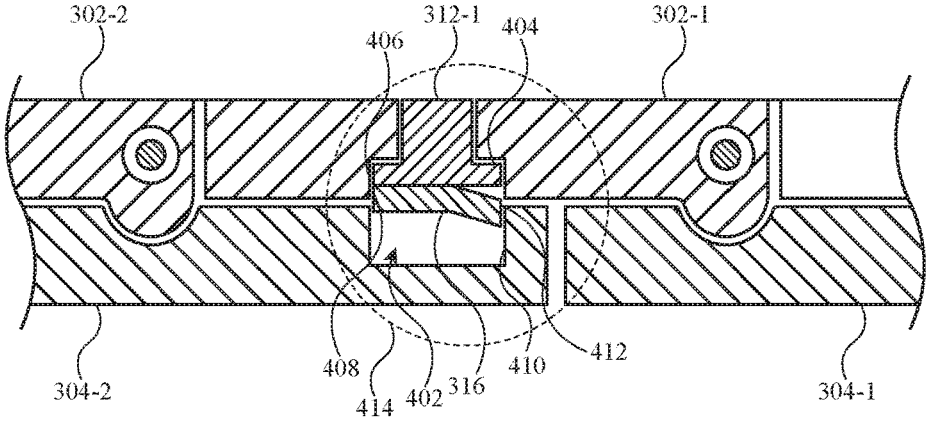
FIG. 4 shows a partial cross-sectional view of the releasable link assembly of FIG. 3 viewed along line 4-4 in FIG. 3.

FIG. 4 is a partial cross-sectional view of the releasable link assemblies 110-1 and 110-2, viewed along line 4-4 in FIG. 3, showing the releasable links coupled to one another. In this configuration, the protrusion 316 extends into the recess 402 in the receptacle link 304-2 as well as into a recess 404 (e.g., a channel) in the latching link 302-1. This configuration results in a first face 408 of the protrusion 316 engaging with a feature 406 of the latching link 302-1. The feature 406 may be a wall that defines the recess 404, or any other wall, protrusion, stud, or other feature that is configured to overlap or otherwise engage the first face 408 of the protrusion 316. As shown in FIG. 4, the first face 408 may partially engage the wall 406 by partially overlapping with the wall 406. In some embodiments, the entire first face 408 may engage (e.g., contact) the wall 406.

This configuration also results in a second face 412 of the protrusion 316 partially engaging or partially overlapping a feature 410 of the receptacle link 304-2. The feature 410 may be a wall of the recess 402, or any other wall, protrusion, stud, or other feature that is configured to overlap or otherwise engage the second face 412 of the protrusion 316.

The button member 312-1 may deflect the protrusion 316 of the spring member 314 into the recess 402 (when the button member is pressed by a user, for example) such that the first face 408 no longer overlaps or engages with the feature or wall 406 of the latching link 302-1 and the latching link 302-1 may be decoupled from the receptacle link 304-2. In other words, the protrusion 316 is pushed entirely out of the recess 404 in the latching link 302-1 so that the latching link 302-1 and the receptacle link 304-2 can be slid apart from one another.

Figure 5A:
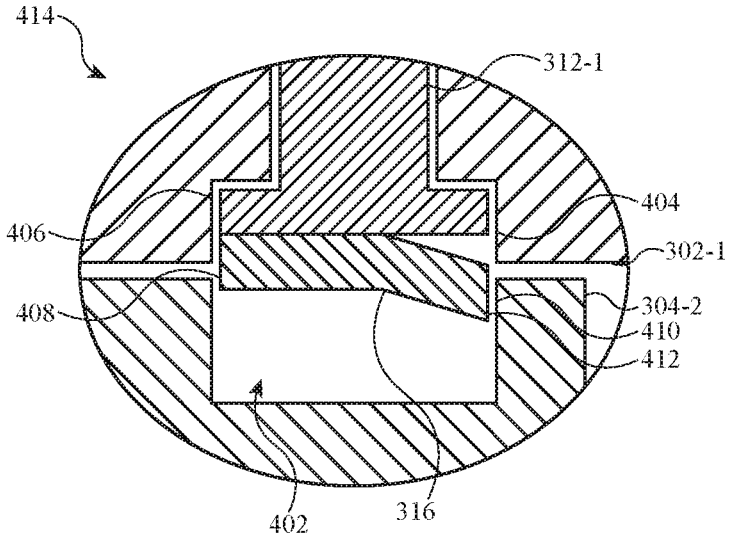
FIGS. 5A-5B show expanded partial cross-sectional views of the releasable link assembly of FIG. 3 viewed along line 4-4 in FIG. 3.
Figure 5B:
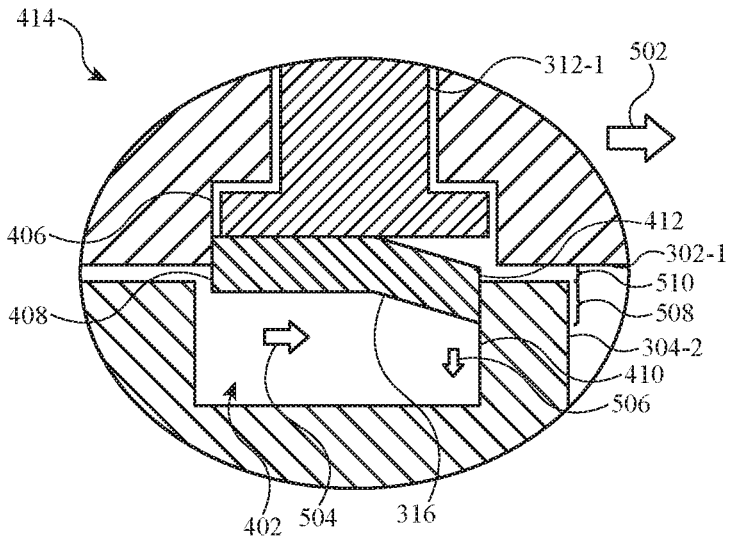

FIG. 5A is an expanded view of the area 414 in FIG. 4, showing the positioning of the first and second faces 408, 412 with respect to the features of the latching link 302-1 and the receptacle link 304-2. FIG. 5A may correspond to a state in which the band 104 is not in significant tension, and thus the protrusion 316 is not imparting appreciable retaining forces on the features (e.g., walls) 406, 410. FIG. 5B is another expanded view of the area 414 in FIG. 4, showing the positioning of the first and second faces 408, 412 with respect to the features 406, 410 when the releasable link assemblies 110-1 and 110-2 are subjected to a decoupling force (e.g., when a relative force in the direction of arrow 502 is applied to the latching link 302-1). The decoupling force causes the latching link 302-1 to move (or be forced) relative to the receptacle link 304-2 such that the feature or wall 406 contacts the first face 408 of the protrusion 316. The force imparted onto the first face 408 by the latching link 302-1 causes the protrusion 316 to be forced towards the feature 410 of the receptacle link 304-2 (as indicated by arrow 504), and forces the second face 412 against the feature 410.

The second face 412 is positioned relative to the feature 410 such that the end of the protrusion 316 of the spring member partially overlaps or partially engages the second face 412. In particular, the second face 412 is positioned relative to the feature 410 such that a first portion 508 of the second face 412 overlaps the feature 410 (e.g., it contacts the feature 410 at least when resisting a decoupling force of a certain magnitude), and a second portion 510 of the second face 412 does not overlap the feature 410 (e.g., is configured to not contact the feature 410, even when resisting a decoupling force). By spanning the edge of the feature 410 in this manner, the protrusion 316 is prevented from twisting or otherwise deforming, which could result in the second face 412 diving or sliding into the recess 402 (as indicated by arrow 506). More particularly, the engagement of the corner of the feature 410 with a central portion of the second face 412 may increase the friction between the second face 412 and the feature 410 to prevent sliding, which, in turn, increases the resistance of the protrusion to twisting, deformation, and/or sliding when the links 302-1, 304-2 are subjected to a decoupling force.

The feature 410 may include a notch, shelf, cutout, protrusion, recess, or other feature that engages with the second face 412 to prevent the protrusion 316 from twisting or sliding with respect to the feature 410. For example, the feature 410 may include a notch into which a portion of the second face 412 is disposed when the latching link 302-1 is subjected to a decoupling force. The physical engagement between the notch and the second face 412 prevents or limits the protrusion 316 from twisting or sliding along the feature 410 (in the direction indicated by arrow 506), and thus increases the strength and/or security of the coupling between the latching link 302-1 and the receptacle link 304-2.

While FIG. 5A shows that the faces 408, 412 of the protrusion 316 are not in contact with the features (e.g., walls) 406, 410, this is merely to illustrate a resting state, and is not necessarily indicative of the mechanical clearances or interferences between these components. Indeed, both faces 408, 412 of the protrusion 316 may be in contact with the respective features 406, 410 even when the links are not subject to a decoupling force, and a decoupling force may result only in the increase or decrease of the pressure generated between those components.

Figure 6A:
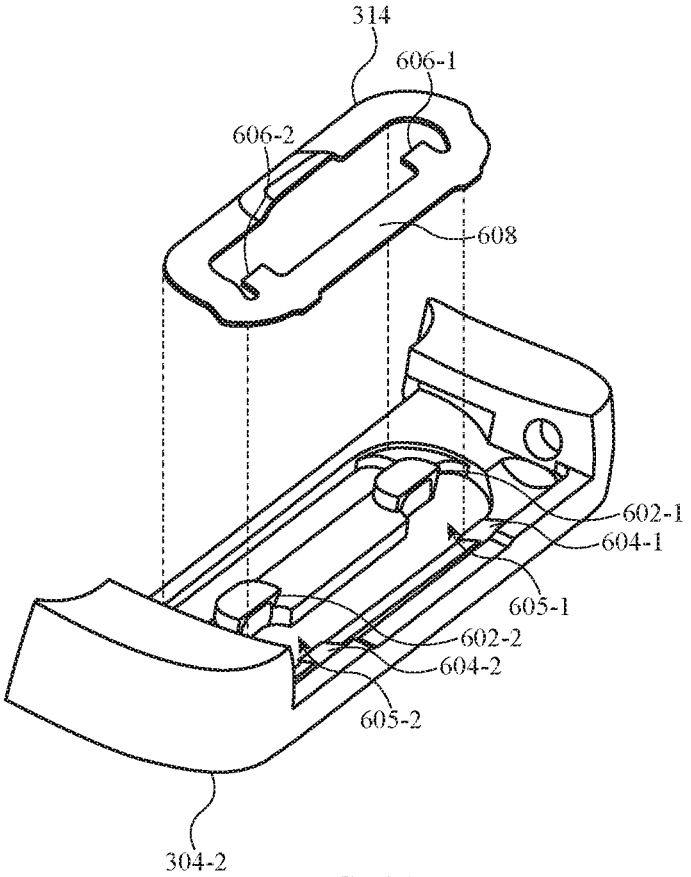
FIGS. 6A-6B show perspective views of a link for a releasable link assembly.
Figure 6B:
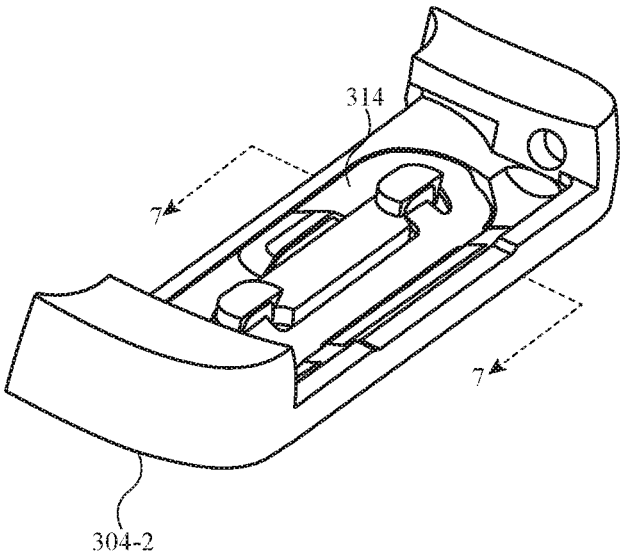

FIG. 6A is an exploded view of the receptacle link 304-2 showing the spring member 314 removed from the body of the receptacle link 304-2. FIG. 6B is a perspective view of the receptacle link 304-2 showing the spring member 314 coupled to the body of the receptacle link 304-2. FIGS. 6A-6B illustrate an example coupling mechanism that may securely retain the spring member 314 to the body of the receptacle link 304-2. This coupling mechanism may allow the spring member 314 to be coupled to the receptacle link 304-2 without joining techniques such as welding, adhering (e.g., with glues, epoxies, or the like), fastening (e.g., with screws, bolts, or rivets), soldering, brazing, or the like. Accordingly, the coupling mechanism described herein may be used where the receptacle link 304-2 is formed from a material that is not well suited to those joining techniques, such as platinum, gold, silver, amorphous metals, ceramics, cermets (e.g., composites of ceramic and metallic materials), carbon fiber composites, or the like (or any combination or alloy of such materials).

The receptacle link 304-2 includes one or more pairs of retention features (e.g., studs 602 and walls 604) separated by a gap, into which the spring member 314 is disposed. For example, a stud 602-1 may protrude from a surface of the body of the receptacle link 304-2 and define a side of a channel 605-1, with a wall 604-1 defining the opposite sides of the channel 605-1. The spring member 314 is configured to be elastically deformed when inserted into the channel 605-1 between the stud 602-1 and the wall 604-1 such that the spring member 314 imparts a retention force against the stud 602-1 and wall 604-1. For example, the spring member 314 may include tabs 606 that extend from a base portion 608 of the spring member 314 and are configured to contact the studs 602.

Figure 7A:
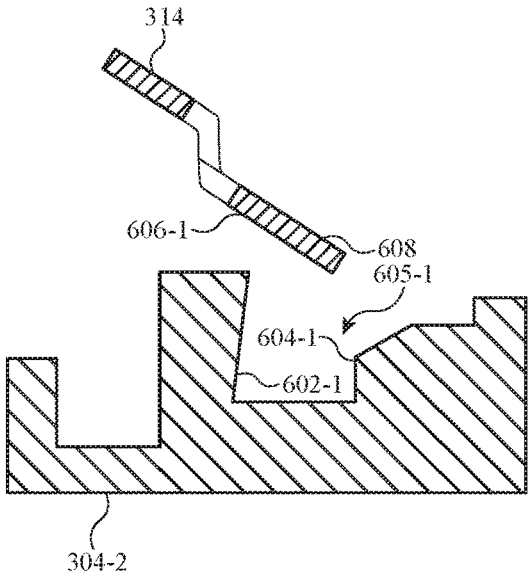
FIGS. 7A-7C show cross-sectional views of the link of FIGS. 6A-6B viewed along line 7-7 in FIG. 6B.
Figure 7B:
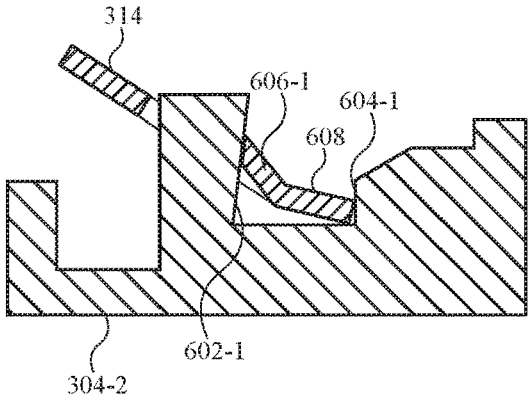
Figure 7C:
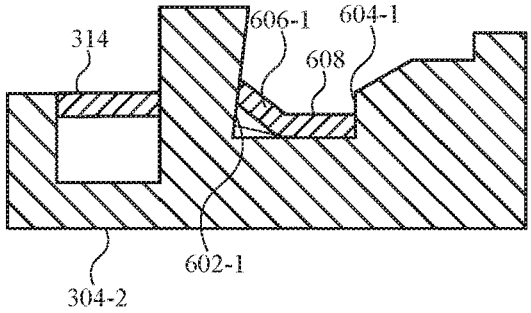

As shown in FIGS. 7A-7C, the tabs 606 are elastically deflected with respect to the base portion 608 when the tabs 606 engage with the studs 602. Because the tabs 606 are elastically deflected when the spring member 314 is coupled to the receptacle link 304-2, the tendency of the tabs 606 to return to an undeflected (or less deflected) state results in the tabs 606 exerting a retention force on both the studs 602 and the walls 604. This force acts to oppose forces that are applied to the spring member 314 that act in a direction that could cause the spring member 314 to become decoupled from the receptacle link 304-2. Moreover, because the force is produced directly between the spring member 314 and the receptacle link 304-2, the spring member 314 can be retained to the receptacle link 304-2 without the use of additional fasteners, welds, adhesives, or the like. This mechanism may reduce the cost and time necessary to manufacture receptacle links 304, and may provide a simpler, lighter, and more robust connection between the spring member 314 and the receptacle links 304.

FIGS. 7A-7C are cross-sectional views of the receptacle link 304-2 viewed along line 7-7 in FIG. 6B, illustrating various stages of a process of coupling the spring member 314 to the receptacle link 304-2. Some aspects of the receptacle link 304-2 are not shown in FIGS. 7A-7C for clarity. In FIG. 7A, the spring member 314 is disposed above the receptacle link 304-2, and has not yet engaged with the stud 602-1 or the wall 604-1. In FIG. 7B, the spring member 314 is in contact with the wall 604-1 (e.g., it is placed in a corner defined by the wall 604-1 and a surface of the body of the receptacle link 304-2), and the tab 606-1 has begun to engage the stud 602-1. At this point, the tab 606-1 has begun to deflect with respect to the base portion 608 of the spring member 314. As shown in FIG. 7C, as the spring member 314 is pressed further into the channel 605-1 (FIGS. 6A, 7A), the tab 606-1 continues to engage with the stud 602-1 as the spring member 314 is pressed into its final position.

The faces of the studs 602 that engage the tabs 606 may have any appropriate contour, feature, radius, shape, or angle to facilitate retention of the spring member 314 to the receptacle link 304-2. For example, the faces may be curved or angled such that the tabs 606 maintain a continuous force against the studs 602 as the spring member 314 is pressed further into the channel 605-1 (FIGS. 6A, 7A). Alternatively, the faces may be curved or angled such that the tabs 606 progressively increase or decrease the amount of force applied to the studs 602 as the spring member 314 is pressed further into the channel 605-1 (FIGS. 6A, 7A).

The process of coupling the spring member 314 to the receptacle link 304-2 may be performed by a human, a machine, or any combination of humans and machines. For example, a human may position the spring member 314 at an appropriate location with respect to the receptacle link 304-2, and then use a tool or machine to apply sufficient force to press the spring member 314 into the channel 605-1 (FIGS. 6A, 7A) between the studs 602 and the walls 604 and deflect the tabs 606 to provide the appropriate retention force.

Figure 8:
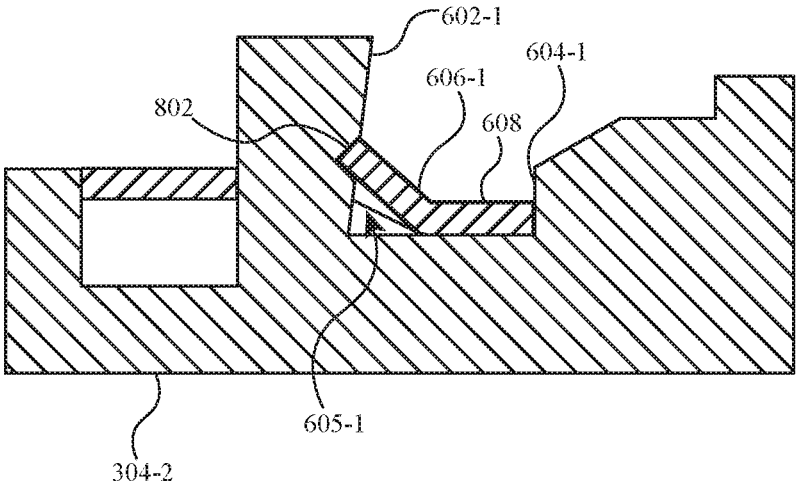
FIG. 8 shows a cross-sectional view of another link for a releasable link assembly viewed along line 7-7 in FIG. 6B.

In some cases, the studs 602 may include undercuts, notches, or other features that receive or otherwise engage with the tabs 606 to retain the spring member 314 to the receptacle link 304-2. For example, FIG. 8 is a cross-section of the receptacle link 304-2 viewed along line 7-7 in FIG. 6B, illustrating an embodiment where the stud 602-1 includes a notch 802 at the location where the tab 606-1 contacts the stud 602-1 when the spring member 314 is in its final position. (Some aspects of the receptacle link 304-2 are not shown in FIG. 8 for clarity.) Once the spring member 314 is positioned in its final position with respect to the body of the receptacle link 304-2, an end of the tab 606-1 snaps into the notch 802, which in turn retains the spring member 314 in the final position. The notch 802 may a recess or groove, as shown, or it may be a widening of the channel 605-1 (FIGS. 6A, 7A), such as an undercut or recess formed in the stud 602-1. The wall 604-1 may include a similar undercut, notch, channel, or other feature to retain the base portion 608 to the wall 604-1.

Figure 9:
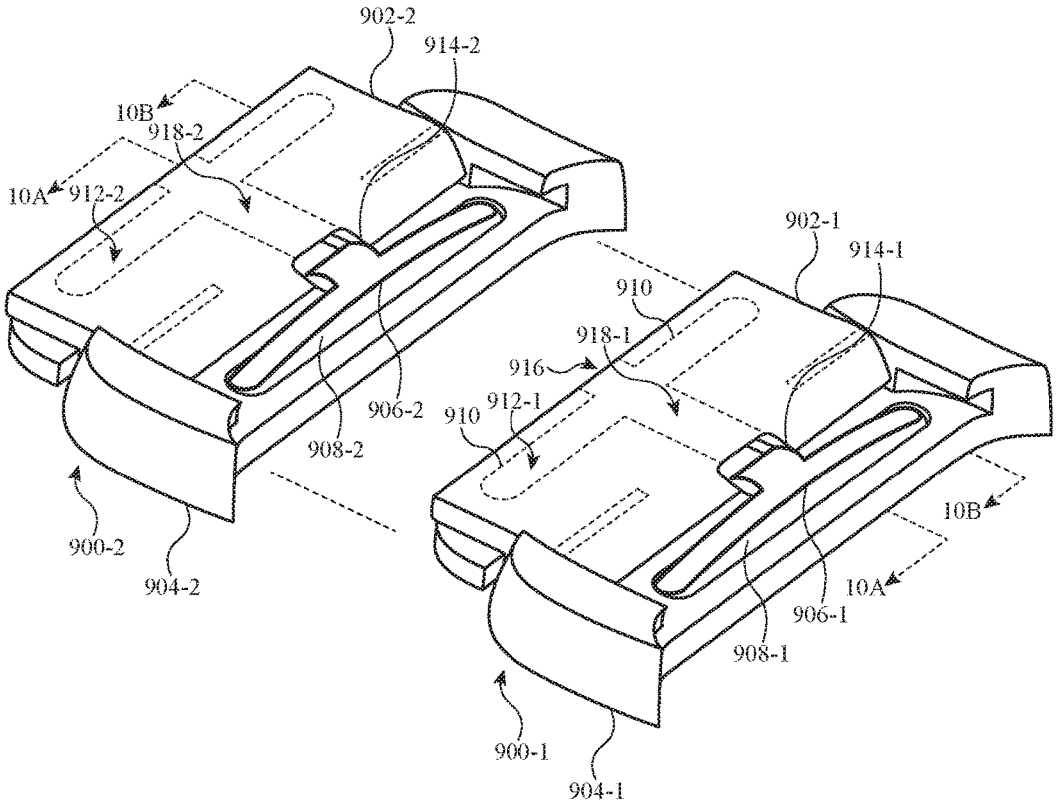
FIG. 9 shows a perspective view of another releasable link assembly.

FIG. 9 is a perspective view of a link assembly 900-1 and a complementary link assembly 900-2. The coupling mechanism used to join complementary link assemblies 900 allows the link assemblies 900 to be removed from one another using a tool, and thus the link assemblies 900 may be considered releasable link assemblies. Accordingly, the link assemblies 900 may be used in place of the releasable link assemblies 110, allowing a user to resize the band 104 with relative convenience. However, because a tool is required to decouple the links from one another, the link assemblies 900 may be used in conjunction with releasable link assemblies 110 (e.g., the link assemblies 900 may be used in place of some or all non-releasable link assemblies 112 in the band 104), such that the user can use the releasable link assemblies 110 to perform most watch resizing operations without tools. In such cases, the releasable link assemblies 110 may provide enough adjustability to the band 104 that it is not necessary to decouple the link assemblies 900, but they may be decoupled if necessary. Of course, any combination of releasable link assemblies 110, non-releasable link assemblies 112, and the link assemblies 900 may be used in a given band.

The link assemblies 900 each include a latching link 902 pivotally coupled to a receptacle link 904, similar to the latching links 302 and receptacle links 304 of FIG. 3. Receptacle links 904 include leaf springs 906 coupled thereto. The leaf springs 906 are coupled to the receptacle links 904 in any appropriate way, including interference fits, mechanical interlocking features (e.g., undercuts, notches, grooves), rivets, bolts, screws, fasteners, welds, and the like.

The leaf springs 906 may be at least partially positioned in recesses 908 in the bodies of the receptacle links 904, and partially positioned outside of the recesses 908. For example, with reference to the link assembly 900-2, the ends of the leaf spring 906-2 are within the recess 908-2. The portion of the leaf spring 906-2 that is within the recess 908-2 may be mechanically coupled to the body of the receptacle link 904-2. A second portion of the leaf spring 906-2 is positioned outside of the recess 908-2 (e.g., it extends above a surface of the receptacle link 904-2 and/or the top of the recess 908-2 so that it can engage with the latching link 902-1). The portion of the leaf spring 906-2 that is positioned outside of the recess 908-2 is configured to engage with lip portions 910 (also referred to as "lips 910") that extend away from the body of the latching link 902-1. The lip portions 910 are configured to engage with the leaf spring 906-2 when the latching link 902-1 is coupled to the receptacle link 904-2 to retain the link assemblies 900-1 and 900-2 together. The lip portions 910 may form sides of a channel 912 (shown in hidden lines) into which part of the leaf spring 906-2 extends when the link assemblies 900-1, 900-2 are coupled together.

The leaf spring 906-2 may include a tongue portion 914-2 that protrudes from the leaf spring 906-2 substantially perpendicularly to a longitudinal axis of the leaf spring 906-2. The tongue portion 914-2 may also be angled toward the body of the receptacle link 904-2. As described herein, the tongue portion 914-2 may be configured such that a downward force (e.g., towards the body of the receptacle link 904-2) applied to the tongue portion 914-2 (e.g., by a tool) causes the leaf spring 906-2 to disengage from the lip portions 910, thus allowing the link assemblies 900-1 and 900-2 to be decoupled from one another. The angle of the tongue portion 914-2 may facilitate engagement with the tool to allow the leaf spring 906-2 to disengage from the lip portions 910.

The lip portions 910 of a given link assembly 900 may be separated by a gap 916 into which a corresponding tongue portion 914 is positioned when the links are coupled together. For example, when the latching link 902-1 is coupled to the receptacle link 904-2, the tongue portion 914-2 may be positioned in the gap 916 between the lip portions 910 of the latching link 902-1. The gap 916 between the lip portions 910 allows the portions of the leaf spring 906-2 that are adjacent the tongue portion 914-2 to extend into the channel 912-1 and engage with the lips 910. In particular, if there were no gap between the lip portions 910, the interference of the tongue portion 914-2 with the lip portions 910 could prevent the leaf spring 906-2 from extending into the channel 912-1.

The latching links 902 may include channels 918 (or structures, tunnels, gaps, or other access clearances) that are aligned with the tongue portions 914 of the leaf springs 906 to allow a tool to access the tongue portions 914. For example, the channel 918-2 allows a tool to pass through a portion of the link assembly 900-2 to reach the tongue portion 914-2 of the leaf spring 906-2. In some embodiments, the channels 918 interrupt or otherwise pass between spring bars or other members that couple the latching link 902-2 to the receptacle link 904-2. The tool may then deflect the leaf spring 906-2 away from the latching link 902-1, thus disengaging the leaf spring 906-2 from the lips 910. FIG. 11 depicts a band 104 in which a tool 1102 has been inserted into a channel 918 to decouple the link assembly 900-2 from the link 900-1.

Figure 10A:
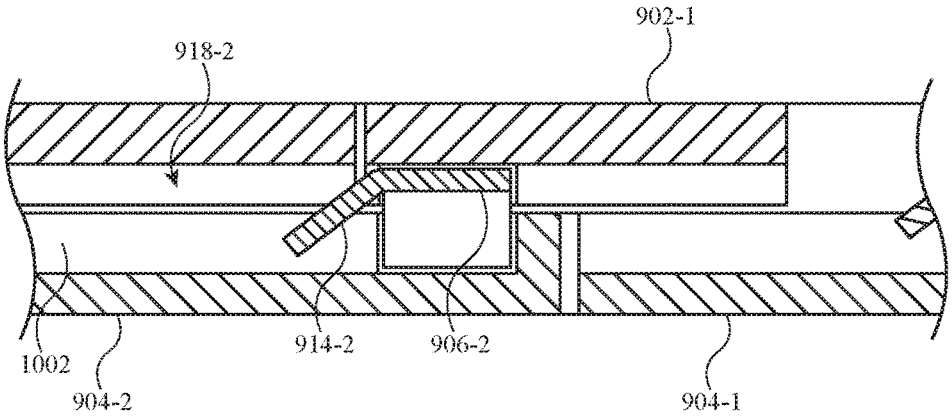
FIG. 10A shows a partial cross-sectional view of the releasable link assembly of FIG. 9 viewed along line 10A-10A in FIG. 9.
Figure 10B:
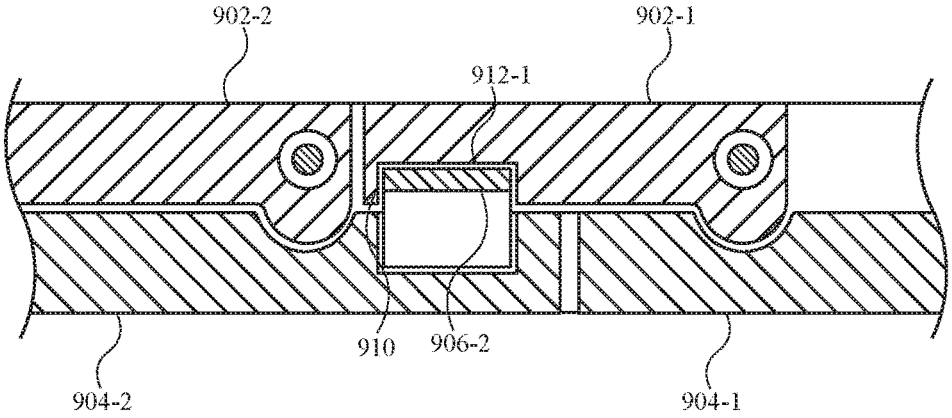
FIG. 10B shows a partial cross-sectional view of the releasable link assembly of FIG. 9 viewed along line 10B-10B in FIG. 9.

FIG. 10A is a partial cross-sectional view of the link assemblies 900-1 and 900-2 viewed along line 10A-10A in FIG. 9, showing the link assemblies coupled to one another. The leaf spring 906-2 extends into the channel 912-1 in the latching link 902-1 (as shown in FIG. 10B). The tongue portion 914-2 extends away from the leaf spring 906-2 and is angled towards the receptacle link 904-2. The tongue portion 914-2 is positioned relative to the receptacle link 904-2 and the latching link 902-2 such that a tool or other implement can be inserted into or through the channel 918-2

(as well as a channel 1002 in the receptacle link 904-2) and engage with the tongue portion 914-2 to decouple the link assemblies 900-1, 900-2. For example, the angle of the tongue portion 914-2 may provide a face having a suitable angle, contour, or shape such that the tool or implement inserted into the channels 918-2 and 1002 is reliably and easily guided into a position against the tongue portion 914-2 to facilitate disengagement of the leaf spring 906-2 from the lips 910 of the latching link 902-1.

FIG. 10B is a partial cross-sectional view of the link assemblies 900-1 and 900-2 viewed along line 10B-10B in FIG. 9. FIG. 10B illustrates a portion of the leaf spring 906-2 that is adjacent the tongue portion 914-2 engaged with the lip 910 to retain the receptacle link 904-2, to which the leaf spring 906-2 is coupled, to the latching link 902-1. As noted above, the portion of the leaf spring 906-2 that engages with the lip 910 in FIG. 10B may be disengaged from the lip 910 when the tongue portion 914-2 is forced towards the receptacle link 904-2, thus forcing the leaf spring 906-2 to be removed from the channel 912-1 in the latching link 902-1. The latching link 902-1 may then be easily slid apart from the receptacle link 904-2.

The latching link 902-1 and/or the leaf spring 906-2 may be configured so that the act of coupling the latching link 902-1 to the receptacle link 904-2 causes the leaf spring 906-2 to be deflected such that the leaf spring 906-2 can move past the lips 910 and properly seat in the channel 912-1. Alternatively, the latching link 902-1 and/or the leaf spring 906-2 may be configured so that a tool (e.g., the tool 1102) must be used to deflect the leaf spring 906-2 away from the latching link 902-1 so that the leaf spring 906-2 can clear the lips 910.

Non-Releasable Link Assemblies

FIG. 12 is a perspective view of a non-releasable link assembly 112-1 and a complementary non-releasable link assembly 112-2. Non-releasable link assemblies 112 may be used in conjunction with releasable link assemblies 110 (and/or link assemblies 900) to form the band 104 or a portion thereof. Non-releasable link assemblies 112 may be stronger, less expensive, and easier to produce than releasable link assemblies 110. Accordingly, including both releasable and non-releasable links in the band 104 may lower the cost of the band and improve its strength while also providing enough adjustability (via the removable links) to fit most users' needs.

Each link assembly 112 includes a latching link 1202 and a receptacle link 1204. For example, in the link assembly 112-2, the latching link 1202-2 is pivotally coupled to the receptacle link 1204-2. Moreover, similar to the releasable link assemblies 110 described above, each latching link (e.g., the latching link 1202-1) is configured to couple to a receptacle link of another link assembly (e.g., the receptacle link 1204-2). While the latching link and receptacle link of a given link assembly (e.g., link assembly 112-1) are pivotally coupled to one another, the coupling between a latching link of one assembly (e.g., the latching link of the link assembly 112-1) and the receptacle link of another assembly (e.g., the receptacle link of the link assembly 112-2) is configured to not allow pivoting (or pivoting is minimized or reduced). Thus, the non-pivoting coupling between separate non-removable link assemblies mimics the non-pivoting coupling between separate releasable link assemblies. In this way, a band 104 that includes both releasable and non-releasable link assemblies maintains a consistent feel and flexibility despite including several different kinds of links.

With reference to FIG. 12, the body of the receptacle link 1204-2 includes an engagement surface 1206 and sidewalls 1208 extending away from the engagement surface 1206. The sidewalls 1208 are separated by a gap 1210.

The latching link 1202-1 is disposed at least partially within the gap 1210 when the link assemblies 112-1, 112-2 are coupled to one another. A body of the latching link 1202 includes a second engagement surface 1212 that is configured to contact the engagement surface 1206 when the link assemblies 112-1, 112-2 are coupled to one another.

The latching link 1202-1 and the receptacle link 1204-2 are coupled and/or retained together via a retention mechanism. For example, in FIG. 12, the body of the latching link 1202-1 includes a through hole 1216 extending from one side surface to another side surface. A spring bar 1214 is configured to be disposed in the through hole 1216, and ends of the spring bar 1214 are configured to be disposed in recesses 1218 in the sidewalls 1208 of the receptacle link 1204-2. Other retention mechanisms may be used instead of or in addition to the spring bar mechanism described above. For example, a spring bar may be used to retain one side of the latching link 1202-1 to the receptacle link 1204-2, and a rigid protrusion may be used on the other side of the latching link 1202-1 to engage with the recess 1218 in the opposite side.

The recesses 1218 may be blind holes, such that the outer surfaces of the receptacle link 1204-2 are not interrupted with openings or access ports to reach the spring bar. In some cases, this may make it difficult or impossible to remove the spring bar 1214 from the recesses 1218 (without damaging the links) to disengage the latching link 1202-1 from the receptacle link 1204-2. This may be acceptable or desirable, however, as these links may be configured as permanently joined links that do not need to be decoupled to resize or disassemble the band 104. For example, the retention mechanism described with respect to FIGS. 12-13 may replace other permanent joining techniques (e.g., welding or brazing) that are not suitable for certain materials. More particularly, welding and brazing may be unsuitable for joining links that are formed from (or include) materials such as platinum, gold, silver, ceramic, amorphous metals or the like. The combination of the spring bar retention mechanism and the pivot-preventing structures of the receptacle links 1204 and the latching links 1202 (described with respect to FIG. 13) provide rigid, secure couplings between links, without requiring welding, brazing, or other fusion-type joining processes.

FIG. 13 is a partial cross-sectional view of the link assemblies 112-1 and 112-2 viewed along line 13-13 in FIG. 12. As illustrated in FIG. 13, the interaction and/or engagement of the engagement surfaces 1206 and 1212 prevents, limits, or constrains the rotation of the latching link 1202-1 with respect to the receptacle link 1204-2. In particular, the dimensions and shapes of the latching and receptacle links 1202-1, 1204-2, as well as the positioning of the through hole 1216 and the recesses 1218 (FIG. 12), may be selected such that the engagement surfaces 1206, 1212 substantially prevent the latching link 1202-1 from rotating relative to the receptacle link 1204-2. For example, in the depicted embodiment, the engagement surfaces 1206, 1212 are both substantially planar or flat, allowing the engagement surfaces 1206, 1212 to form a continuous contact region between them. Moreover, the engagement surface 1212 of the latching link 1202-1 includes an overhanging portion extending beyond the through hole 1216 sufficiently far to prevent the latching link 1202-1 from rotating in a counterclockwise direction (based on the orientation of FIG. 13).

For example, a distance 1304 between the center of the spring bar 1214 and a corner 1302 of the latching link 1202-1 may be longer than a distance 1306 from the center of the spring bar 1214 to the engagement surface 1206 of the receptacle link 1204-2. The overhanging portion of the latching link 1202-1 causes the engagement surface 1212 of the latching link 1202-1 (and in particular the corner 1302) to be forced against the engagement surface 1206 of the receptacle link 1204-2 such that rotation of the latching link 1202-1 is prevented.

Rotation or pivoting of the latching link 1202-1 with respect to the receptacle link 1204-2 may be substantially completely prevented. For example, the latching link 1202-1 may be prevented from rotating more than about +/−1 degree relative to the receptacle link 1204-2. In some cases, the latching link 1202-1 may be prevented from rotating more than about +/−2, 5, 7, or 10 degrees relative to the receptacle link 1204-2. In some cases, the latching link 1202-1 is prevented from freely rotating at all relative to the receptacle link 1204-2 (e.g., to the extent that the links rotate relative to one another, it results from application of a force sufficient to deform the material, rather than the free rotation).

While the example links shown in FIGS. 12-13 include substantially flat engagement surfaces 1206, 1212, any other appropriate shape or shapes may be used. For example, the engagement surfaces may have interlocking structures (e.g., complementary saw-toothed profiles, tongue-and-groove features, or any other complementary recesses and protrusions) that provide mechanical interference that prevents or limits rotation of the latching links 1202 with respect to neighboring receptacle links 1204.

Clasps

Figure 14A:
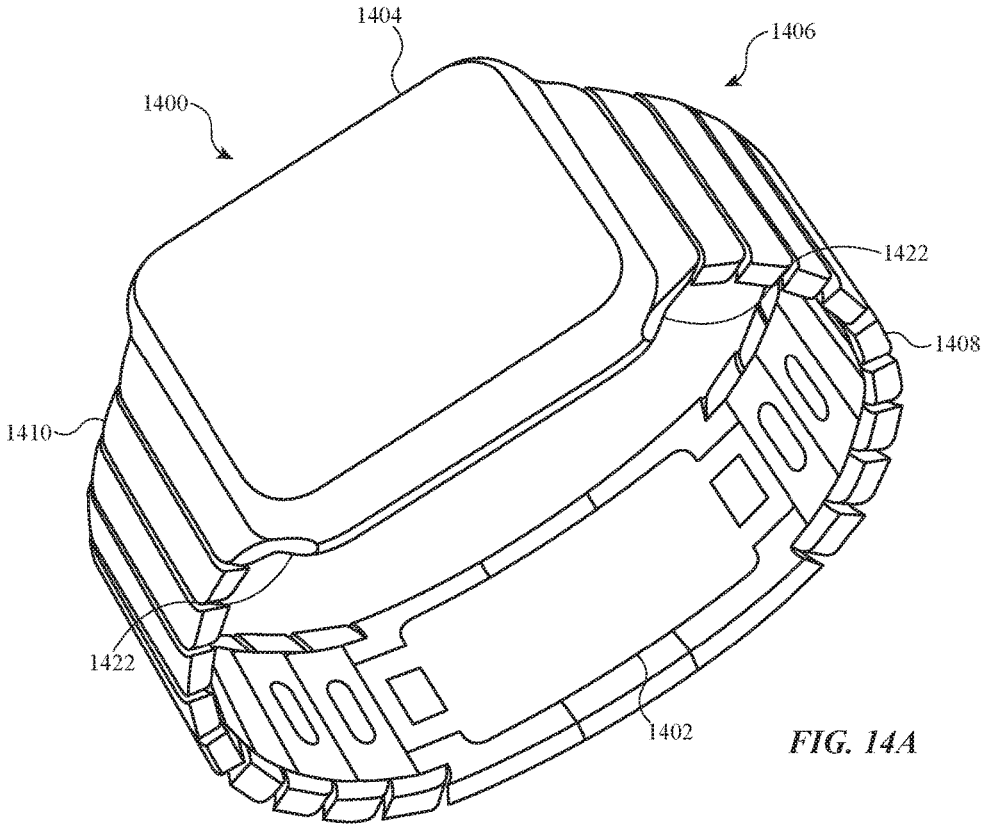
FIGS. 14A-14B show perspective views of yet another wearable electronic device.

As noted above, bands for watches and other wearable devices, whether they include releasable link assemblies or not, may have clasps that allow the user to open and close the band to facilitate application and removal of the device from the user's wrist. FIG. 14A is an illustrative perspective view of one example of a wearable device 1400 (also referred to as "device 1400") that includes a clasp assembly 1402 in accordance with some embodiments. As described herein, the clasp assembly 1402 (or simply "clasp 1402") may be used in conjunction with a band that includes releasable link assemblies (e.g., releasable link assemblies 110) and/or non-releasable link assemblies (e.g., link assemblies 112). In some cases, however, the clasp 1402 may be used in conjunction with bands that do not include such assemblies, such as leather, cloth, or mesh bands, or bands made of other materials or links.

Returning to FIG. 14A, the device 1400 may include a housing 1404. The housing 1404 may include mounting features formed on opposite ends to connect a wearable band 1406 (also referred to as "band 1406") to the housing 1404. For example, the housing 1404 includes channels 1422 into which engagement members 1502 (FIG. 15) of the band 1406 may be disposed. For example, the engagement members 1502 of the band 1406 may be slid into (or out of) the channels 1422 through an opening in a side of the housing 1404. Retention means (not shown) on the insides of the channels 1422 may prevent the engagement members 1502 of the band 1406 from unexpectedly sliding out of the channels 1422. The engagement members 1502 may be lugs, cylinders, beams, rods, or any other appropriate member or component that slides into or out of a channel (e.g., the channels 1422) of a housing to attach or otherwise couple the band 1406 to the housing.

As shown in FIG. 14A, and discussed herein, the band 1406 may include a first strap 1408 and a second strap 1410 positioned opposite the first strap 1408. The band 1406 may also include a clasp 1402 coupled to the first strap 1408 and the second strap 1410. The band 1406, and specifically the first strap 1408, the second strap 1410, and the clasp 1402, may be used to secure the device 1400 to a user, or to any other object capable of receiving the device 1400.

Figure 14B:
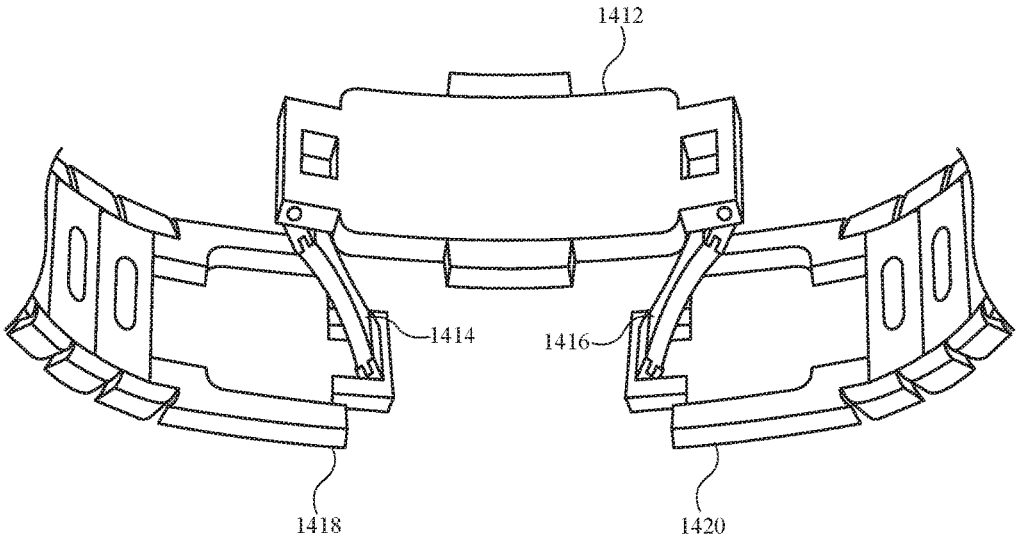

FIG. 14B illustrates a perspective view of the clasp 1402, showing the clasp 1402 in a partially open configuration. In this example, the clasp 1402 includes a clasp body 1412 pivotally coupled to first and second connecting arms 1414, 1416. The connecting arms 1414, 1416 are pivotally coupled to respective clasp covers 1418, 1420. The operation of the pivoting couplings between the connecting arms 1414, 1416 and the clasp body 1412 and respective clasp covers 1418, 1420 allows the clasp 1402 to articulate or move between an open configuration and a closed configuration. In the closed configuration, the connecting arms 1414, 1416 are disposed at least partially between the clasp body 1412 and the clasp covers 1418, 1420 such that the clasp covers 1418, 1420 may engage with the clasp body 1412 via a latching mechanism to secure the clasp 1402 in a closed configuration.

While FIGS. 14A-14B illustrate a clasp 1402 that has two connecting arms and two clasp covers, a clasp 1402 (having a clasp body 1412) may instead include only one connecting arm and only one clasp cover. It will be understood that the descriptions of the various mechanisms and connecting arm configurations and materials described herein apply equally to either type of clasp.

Figure 15:
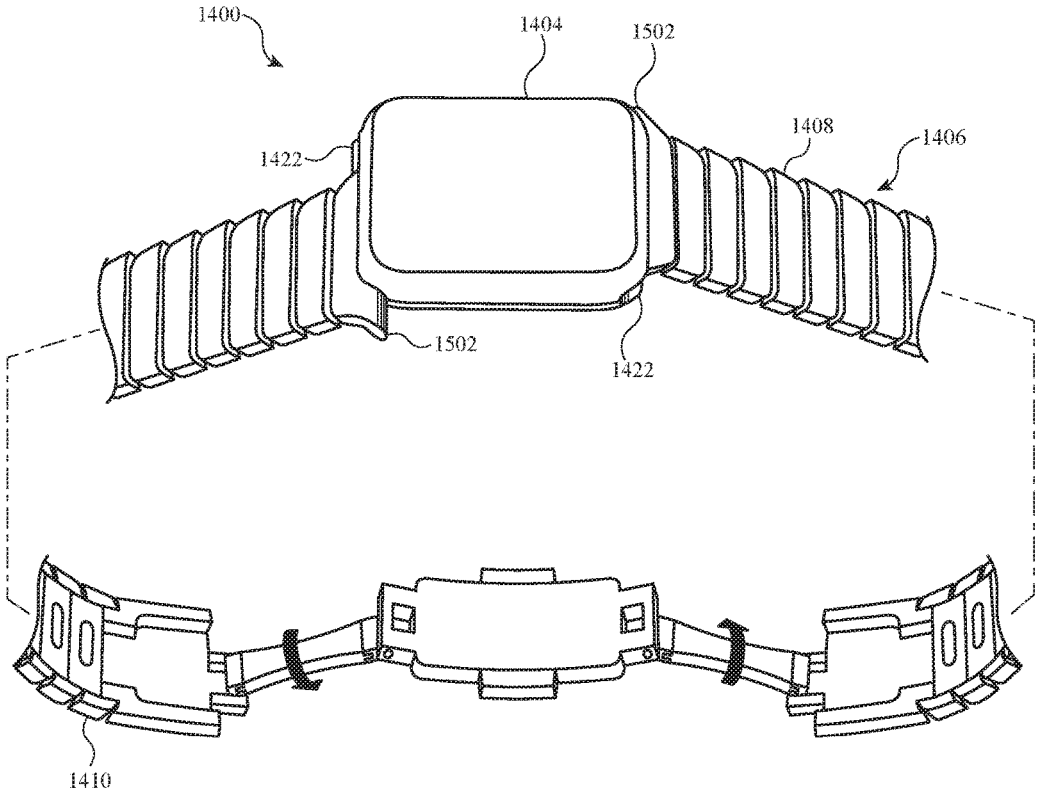
FIG. 15 shows a perspective view of the wearable electronic device of FIG. 14A.

The connecting arms 1414, 1416 may be configured to flex in one or more directions. In particular, certain manipulations of the band 1406 may result in a stress or force being applied to the connecting arms 1414, 1416. For example, coupling or decoupling the band 1406 to or from the housing 1404 may include sliding the engagement members 1502 of the band 1406 into or out of the channels 1422 in the housing 1404. This action may require the band 1406 to be twisted, bent, or otherwise deformed in order to accommodate or allow the movement of the engagement members 1502 that is necessary for coupling and/or decoupling. FIG. 15 shows a perspective view of the device 1400 as the band 1406 is partially decoupled from the housing 1404. In particular, the engagement members 1502 of the band 1406 are partially removed from the channels 1422 of the housing 1404, resulting in the band 1406 (and/or the clasp 1402) being twisted, bent, or otherwise deformed.

Where the band 1406 includes rigid links, such as the releasable or non-releasable link assemblies 110, 112, the band 1406 may not be able to accommodate the amount of twisting or deformation necessary to couple the band 1406 to or decouple it from the housing 1404. Accordingly, the connecting arms 1414, 1416 (or flexible connecting arms 1414, 1416) may be formed from a material that is rigid, stiff, and/or strong enough to securely couple the clasp body 1412 to the clasp covers 1418, 1420 (as well as to maintain the appropriate alignment between these components), while also being flexible enough to allow the band 1406 to be twisted during coupling and decoupling without damaging the links of the band 1406 or the clasp 1402 itself. In particular, the flexible connecting arms 1414, 1416 may be configured to deform (or capable of deforming) from an undeformed shape (e.g., a resting or unstrained shape) during coupling/decoupling of the band 1406 and the housing 1404, and also to return to the undeformed shape after the band 1406 is coupled to or decoupled from the housing 1404.

Figure 16:
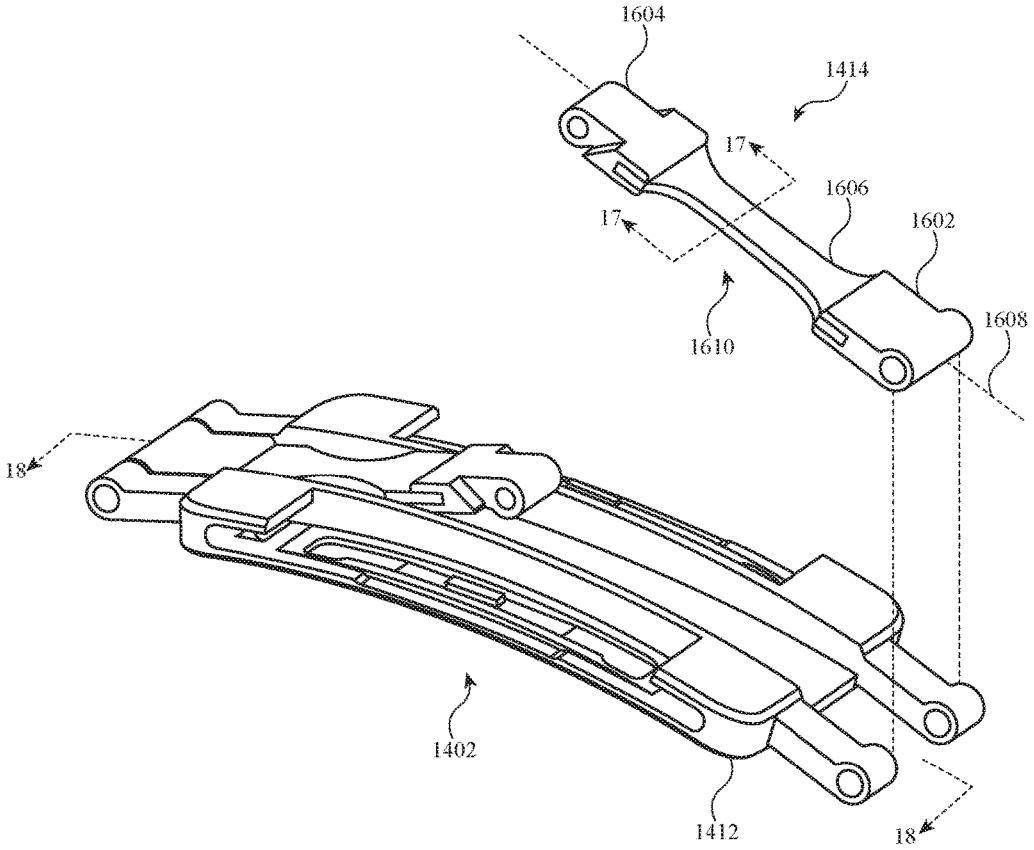
FIG. 16 shows a perspective view of a clasp.

FIG. 16 is an expanded perspective view of a portion of the clasp 1402. The flexible connecting arm 1414 includes lugs 1602, 1604 at opposite ends of a flexible member 1606. Alternatively, the flexible connecting arm 1414 may include one lug. As yet another alternative, the flexible connecting arm 1414 may include no lugs, and entire connecting arm 1414 may be formed from a monolithic flexible member. The flexible member 1606 may be formed from any appropriate material, including, but not limited to, high-strain metals, amorphous metals, shape-memory metals, superelastic metals, and pseudoelastic metals. For example, the flexible member 1606 may be formed from a nickel-titanium metal alloy (e.g., Nitinol) or a beta-titanium alloy.

The flexible member 1606 extends along a longitudinal axis 1608, and may be configured to bend away from and/or twist about the longitudinal axis 1608, without plastically deforming (e.g., becoming permanently bent or deformed), in order to allow the band 1406 to be coupled to or decoupled from the housing 1404. For example, the flexible member 1606 may be able to bend away from the longitudinal axis 1608 or twist about the longitudinal axis 1608 by at least +/−5, 10, 15, or 20 degrees (or any other appropriate amount) without plastically deforming.

The shape of the flexible member 1606 may be configured to allow the desired amount of bending, and to direct the bending to the desired location along the flexible member 1606. For example, the flexible member 1606 may have a central portion 1610 that is narrower than its end portions, such that twisting or bending forces applied to the flexible member 1606 result primarily in deformations within the central portion 1610.

Figure 17:
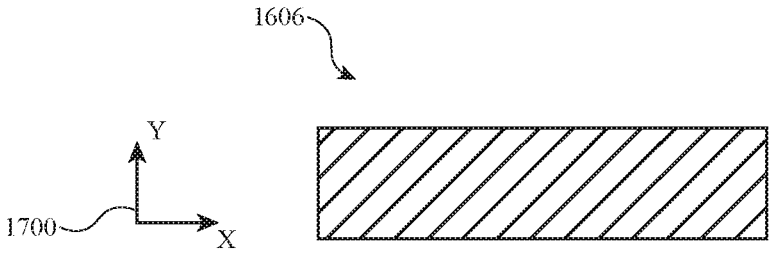
FIG. 17 shows a cross-sectional view of a portion of the clasp of FIG. 16 viewed along line 17-17 in FIG. 16.

Additionally, the size and/or shape of the central portion 1610 may be optimized to be less stiff (e.g., more flexible) in certain directions and/or in certain locations than in other directions and/or locations. For example, FIG. 17 is a cross-sectional view of the flexible member 1606 viewed along line 17-17 in FIG. 16. The rectangular cross-section of the flexible member 1606 may be more flexible in the +/−y directions than in the +/−x directions (as illustrated by coordinate system 1700). The rectangular cross-section of the flexible member 1606 may also allow twisting about the +/−z direction (e.g., into/out of the page). The flexibility of the flexible member may correspond to any appropriate measure of stiffness or resistance to deformation, such as an elastic modulus of a material, or a stiffness constant of the flexible member 1606 (e.g., an amount of deflection per unit force applied to the flexible member).

The flexibility of the flexible member 1606 may also provide a biasing force between the clasp body 1412 and the clasp covers 1418, 1420. For example, the flexible member 1606 may be configured to be elastically deformed (e.g., bent) when the clasp 1402 is closed. The tendency of the flexible member 1606 to return to its undeformed or unbent state (e.g., the biasing force created by the flexible member 1606) may result in the clasp 1402 at least partially separating under its own force (e.g., "popping" open) when a user unlatches or "opens" the clasp 1402. This allows a user to more easily manipulate the clasp 1402, and may obviate the need to apply complex manipulations to the clasp 1402 to both unlatch the clasp 1402 and unfold the mechanism. Moreover, the clasp 1402 may be retained in a closed configuration by operation of hook-shaped latches or catches, and a force that biases the latch toward an open configuration may help to force the hook of the latch against a retaining structure, thereby increasing the strength and the security of the clasp.

Figure 18A:
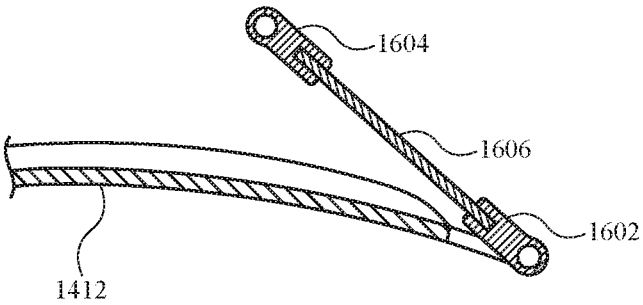
FIGS. 18A-18B show partial cross-sectional views of the clasp of FIG. 16 viewed along line 18-18 in FIG. 16.
Figure 18B:
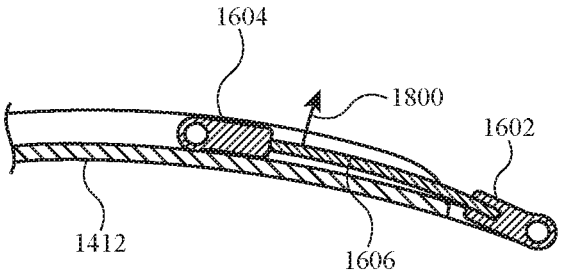

In order to generate the biasing force, the flexible member 1606 may be configured to contact or otherwise engage with the clasp body 1412 (or any other appropriate component) to cause the flexible member 1606 to bend when the clasp 1402 is closed. FIGS. 18A-18B are partial cross-sections of the clasp 1402 viewed along line 18-18 in FIG. 16. FIG. 18A illustrates the clasp 1402 in a partially open (e.g., not fully closed) configuration, where the flexible member 1606 is not engaged with the clasp body 1412, and thus is not elastically deformed. FIG. 18B illustrates the clasp 1402 in a closed configuration, where the flexible member 1606 has contacted the clasp body 1412, causing the flexible member 1606 to be bent to conform to the contour of the clasp body 1412. As noted above, the flexible member 1606 may be formed from a material that can sustain high strains without plastically deforming. The tendency of the flexible member 1606 to un-bend (e.g., return to an undeformed state) imparts a biasing force between the clasp body 1412 and the clasp cover 1418 (FIG. 14) that tends to separate these components (as illustrated by arrow 1800).

The flexible member 1606 may be configured to provide the biasing force (e.g., the force that causes the clasp 1402 to "pop" open and to help engage the retention latches of the clasp) in addition to being flexible enough to allow the band 1406 to accommodate the forces applied thereto while it is being coupled to or decoupled from the housing 1404. Alternatively, the flexible member 1606 (or, more generally, the clasp 1402) may be configured to provide only one of these functionalities. For example, a flexible member of a clasp may be configured to allow the clasp to bend during application or removal of the band, but may not impart a biasing force tending to open the clasp. Similarly, a flexible member that provides a biasing force may not have sufficient material or structural properties to deform without breakage or damage while the band 1406 is being applied to or removed from an electronic device housing.

In the foregoing figures and description, similar instances of particular components may be designated by additional numbers or appended to the element number. For example, particular instances of receptacle links may be designated 304-1, 304-2, etc. It will be understood that any discussion related to an individual instance of a component (e.g., the receptacle link 304-1) may also apply to other instances of that component (e.g., the receptacle link 304-2). Moreover, where the discussion refers to an element number without any additional number or indicator (e.g., the receptacle links 304), the discussion may apply to any or all instances of that component.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A band configured to couple a device to a body of a user, comprising:

a first link comprising a recess defined in a body of the first link;

a leaf spring positioned in the recess and comprising a tongue portion protruding from the leaf spring; and a second link coupled to the first link and comprising first and second lip portions protruding away from a body of the second link and separated from one another by a gap, the second link forming a channel that extends alongside the first and second lip portions and intersects the gap;

wherein:

the leaf spring extends into the channel of the second link alongside the first and second lip portions;

the tongue portion is positioned in the gap between the first and second lip portions;

the first and second lip portions engage the leaf spring to retain the second link to the first link; and the tongue portion is configured such that a force applied to the tongue portion in a direction towards the recess of the first link and away from the channel of the second link causes the leaf spring to disengage from the first and second lip portions.

2. The band of claim 1, comprising:

a group of link assemblies forming two straps of a wrist band, each strap coupled to an electronic device; and a clasp mechanism coupling the two straps together; wherein the first link is part of a first link assembly of the group of link assemblies;

the second link is part of a second link assembly of the group of link assemblies;

the first and second link are removable from one another using a tool; and at least the first link and the second link are formed of a metallic material.

3. The band of claim 1, wherein:

a first portion of the leaf spring is positioned within the recess;

a second portion of the leaf spring is disposed outside of the recess; and the tongue portion extends from the second portion of the leaf spring.

4. The band of claim 3, wherein the tongue portion extends substantially perpendicularly to a longitudinal axis of the leaf spring.

5. The band of claim 1, wherein the first link comprises a first engagement structure and the second link comprises a second engagement structure, wherein the first engagement structure and the second engagement structure, when engaged, limit movement of the first link relative to the second link such that the first lip portion and the second lip portion must pass over the leaf spring before the first link and the second link can be separated.

6. The band of claim 3, further comprising a third link pivotally coupled to the first link and comprising an additional channel formed therein, wherein the additional channel is aligned with the tongue portion of the leaf spring to allow access to the tongue portion by a tool.

7. A band configured to couple a device to a body of a user, comprising:

a first link comprising a first recess defined by a first wall, the first link further comprising a button member;

a second link removably coupled to the first link and comprising a second recess defined by a second wall, the first and second walls facing opposite directions and separated from one another by a space; and a spring member disposed in the space and comprising:

a first face configured to engage the first wall; and a second face configured to partially engage the second wall by partially overlapping the second wall, wherein the spring member is configured to limit movement of the first link with respect to the second link until deflected by the button member of the first link;

wherein:

the first link is pivotally coupled to a third link to form a first link assembly;

the second link is pivotally coupled to a fourth link to form a second link assembly; and the first link assembly is coupled to the second link assembly via the coupling between the first link and the second link.

8. The band of claim 7, wherein, when the first link or the second link is subjected to a decoupling force:

a first portion of the second face contacts a portion of the second wall; and a second portion of the second face does not contact the second wall.

9. The band of claim 8, wherein, when the first link or the second link is subjected to the decoupling force, the first face is forced against the first wall such that a first portion of the first face contacts the first wall to inhibit decoupling of the first link from the second link.

10. The band of claim 7, wherein the first face is configured to partially engage the first wall.

11. The band of claim 7, wherein the button member is configured to deflect the spring member into the second recess such that the first face of the spring member disengages from the first wall, thereby allowing the first link to be decoupled from the second link.

12. The band of claim 7 wherein:

the first link includes a channel formed therein;

the second link includes a slide member extending from a body of the second link; and the slide member is received in the channel to substantially prevent rotation of the first link relative to the second link.

* * * * *